US005504947A

United States Patent [19]

Robello et al.

[11] Patent Number: 5,504,947

[45] Date of Patent: Apr. 9, 1996

[54] AUTOMATIC TOILET SEAT LOWERING APPARATUS

[76] Inventors: Russell J. Robello; Deborah A. Robello, both of 7670 Westwood Dr., Apt. 710, Tamarac, Fla. 33321

[21] Appl. No.: 423,775

[22] Filed: Apr. 18, 1995

[51] Int. Cl.[6] ..... A47K 13/10

[52] U.S. Cl. ..... 4/246.1; 4/246.3; 4/248

[58] Field of Search ..... 4/246.1, 246.2, 4/246.3, 246.4, 246.5, 246.6, 248, 250, 408

[56] References Cited

U.S. PATENT DOCUMENTS

| | | | |
|---|---|---|---|
| 3,781,924 | 1/1974 | Davis, Jr. | 4/246.2 |
| 4,551,866 | 11/1985 | Hibbs | 4/246.1 |
| 4,995,120 | 2/1991 | Tager . | |
| 5,014,367 | 5/1991 | Gamblin | 4/246.2 |
| 5,058,216 | 10/1991 | Trayer . | |
| 5,103,506 | 4/1992 | Monford et al. | 4/246.4 |
| 5,280,653 | 1/1994 | Tsai . | |
| 5,289,593 | 3/1994 | Lawrence . | |
| 5,307,524 | 5/1994 | Veal | 4/246.1 |
| 5,327,589 | 7/1994 | Rice | 4/246.2 |
| 5,369,814 | 12/1994 | Denys . | |

FOREIGN PATENT DOCUMENTS

| | | | |
|---|---|---|---|
| 487892 | 12/1929 | Germany | 4/246.4 |

*Primary Examiner*—Henry J. Recla
*Assistant Examiner*—Charles R. Eloshway
*Attorney, Agent, or Firm*—McHale & Slavin

[57] ABSTRACT

An automatic toilet seat closing apparatus that operates on a controlled release of air. A control cylinder coupled to a seat closure member is secured to a conventional toilet bowl by placement of a universal support base positionable beneath the coupling hinge used by the seat. A water sensor is available for placement in a conventional water closet allowing release of air when the water level drops due to flushing of the toilet bowl. Alternatively, the apparatus will allow a controlled lowering of the toilet seat allowing the apparatus to be coupled to toilet bowls having water savers or non-conventional water closets such as those found on motor homes and boats. In addition, the device may be integrated into new toilet structures thereby eliminating the need for a separate support base.

18 Claims, 3 Drawing Sheets

AUTOMATIC TOILET SEAT LOWERING APPARATUS

FIELD OF THE INVENTION

This invention relates to the field of toilet seat closure and in particular to an apparatus for automatically lowering a lifted toilet seat providing automatic closure.

BACKGROUND INFORMATION

A peculiarity of present day culture relates to proper washroom etiquette. Since the advent of indoor plumbing, the use of a washroom has expanded to include a waste facility commonly referred to as a toilet. For purposes of saving on space, cost of installation, and maintenance, it is common for a washroom to have a single toilet shared by both males and females. For this reason, commonly accepted toilet construction is to accommodate both male and females using a fixed water basin with a hinged seat/seat cover.

The hinged seat/seat cover benefits the male who has an ability to use the toilet with the seat in a raised position. This leads to a conflict in that it is deemed proper etiquette for the male to return the seat to a horizontal position for the benefit of the female. While some males are accustomed to performing this task, it is not uncommon for males to forget or lack the courtesy to accomplish such a task. For this reason, a number of devices for automatically lowering of a toilet seat have been patented. All such devices have a common goal in lowering or closing of the toilet seat upon flushing of the toilet.

U.S. Pat. No. 4,995,120 discloses a toilet seat closing device incorporating a reversible direct current motor which is coupled to a ratcheting clutch mechanism attached to the toilet seat. The problem arises in that electricity is not commonly available close to the toilet. Installation necessitates either an electrical cable drawn through the washroom or an electrical socket placed near the toilet. In either event, electricity and water can lead to a dangerous situation as it is not uncommon for a toilet to overflow.

U.S. Pat. No. 5,058,216 discloses a compressible actuator positioned within the water closet capable of sending air pulses to a bladder placed between the water closet and seat cover. When the actuator is sufficiently compressed it expands the bladder causing the seat cover to be pushed closing the seat. A problem with this device is that no provision is made to set the seat down gently allowing the possibility that such a quick closure will cause the base of the toilet to shatter. Thus, this disclosure requires the use of enlarged bumpers placed beneath the seat so as to cushion the impact.

U.S. Pat. No. 5,280,653 discloses an energy transceiver comprised of a spring with a pressure plate acting as its seat in a controlled drum. The energy transceiver accumulates potential energy released by the toilet seat during the descent to a point where closure of the seat stops the operating fluid thereby releasing the energy accumulated therein. This device is unique, yet quite complicated and by its very nature necessitating direct connection to the water which may lead to early fouling of the apparatus.

U.S. Pat. No. 5,289,593 discloses still another automatic closure device for toilet seats. This embodiment discloses the use of a weight having a specific gravity slightly higher than water. A cable is attached between the weight and the seat allowing for the lowering of the seat. When the toilet is flushed the water table in the water closet increases the force supplied by the weight and pulls on the cable. While an objective of the disclosure is simplicity, it is noted that proper positioning of a weight and pulley mechanism must be performed for operation.

U.S. Pat. No. 5,369,814 discloses yet another seat closing device. This disclosure allows for closure by use of a water actuated piston which couples to the pressure side of an incoming water line. While this invention has greatly simplified devices of the prior art, it still requires coupling to a component that may lead to subsequent problems. Namely, any time a component that has movable parts coupled to water has a possibility of leaking which may result in flooding of the bathroom. In addition, despite the simplicity of the disclosure the necessity remains that a water line must be spliced and pressure tubing installed for handling of water pressure.

Thus, what is needed in the art is an inexpensive automatic toilet seat closing device that does not require water or electricity to operate with conventional water closet toilets as well as with toilets having non-conventional flushing mechanisms.

SUMMARY OF THE INVENTION

The instant invention satisfies these needs through the provision of an automatic toilet seat lowering apparatus that operates on ambient air. The apparatus consists of a support base positionable between seat/seat hinged mounting brackets that secure the seat/seat cover to an upper surface of the toilet bowl. Adjustments are provided in the support base allowing the attachment to various sized mounting holes having diverse spacing patterns allowing the base to adapt to most every type of toilet bowl manufactured. A side portion of the support base extends downwardly along a side surface of the toilet bowl for use as a support bracket to a control cylinder operating on air which is coupled to a seat closure member having an annular design for off-center leverage lifting. One end of the seat closure member is coupled to the control cylinder piston rod and a second end slidably coupled to a bracket secured to a bottom portion of the toilet seat. A water level sensor is placed in a conventional water closet utilizing a bracket that hangs over a side wall of the water closet allowing submersion of a float valve. Replacement of the water closet cover secures the bracket in position. The float valve includes a needle actuator coupled to the cylinder by an air line controlling the amount of air released from the cylinder.

In operation when the toilet bowl is used by a male the seat cover may be raised into a vertical position allowing the seat closure member to raise causing an extension of the piston rod. While the piston rod is extended, air is drawn into the cylinder past a uni-directional air seal on a piston. The float valve on the water level sensor is maintained in a raised position forcing a needle valve to seal the air tube coupled to the cylinder from passage of air. Upon flushing of the toilet, the water level in the water closet is dropped causing the float valve to be lowered releasing the needle valve's seal permitting air to be expelled from the air cylinder through the air tube and into the water closet. While air is being expelled, the seat cover is lowered from its raised position to a horizontal seat position in an automatic manner. A spring is provided for use in conjunction with the seat for those instances where the seat is placed over-center assisting in replacement of the seat to the horizontal position. The speed of the seat closure is adjusted by use of a valve placed between the float and the control cylinder so as to regulate the air flow through the coupling hose. Slow closure prevents slamming of the seat that may cause injury to small children and/or damage to the fragile glass bowl structure.

Unique to the instant invention is its ability to operate with the recently introduced water saving tanks. In this manner the water sensor is removed and the seat closure is performed by a slow release of air. When the seat is raised, by tuning of the valve means the seat may slowly return to a horizontal position taking from two to ten minutes to effect closure. This is especially useful for motor homes and boats where it is required that the seat be in a closed position during movement. For instance, a boat may use a porcelain toilet bowl and should the boat hit a wave when the seat is raised, the tilting of the boat will cause the seat to slam shut typically cracking the toilet bowl. In instances where water is flushed by a hand or electric pump, the apparatus provides for automatic seat closure without a water sensor.

The device may also be integrated into an OEM toilet eliminating the need for a support base by incorporating all support into the structure of the toilet.

Thus, an objective of the instant invention is to provide an inexpensive automatic seat closing mechanism that may be installed without the use of water or electrical connections.

Still another objective of the instant invention is to disclose the use of an adjustable valve so as to allow regulation of the speed of closing as well as accommodate components that are wearing due to age or clogging.

Still another objective of the instant invention is to provide the use of a float valve situated within an upper portion of a conventional water closet to detect when a toilet is flushed.

Another objective of the instant invention is to provide an automatic toilet bowl closer for non-conventional water closets wherein a controlled release of air allows slow seat closure over a period of time.

Other objectives and advantages of this invention will become apparent from the following description taken in conjunction with the accompanying drawings wherein are set forth by way of illustration and example, certain embodiments of this specification and include exemplary embodiments of the present invention and illustrate various objectives and features thereof.

DETAILED DESCRIPTION

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
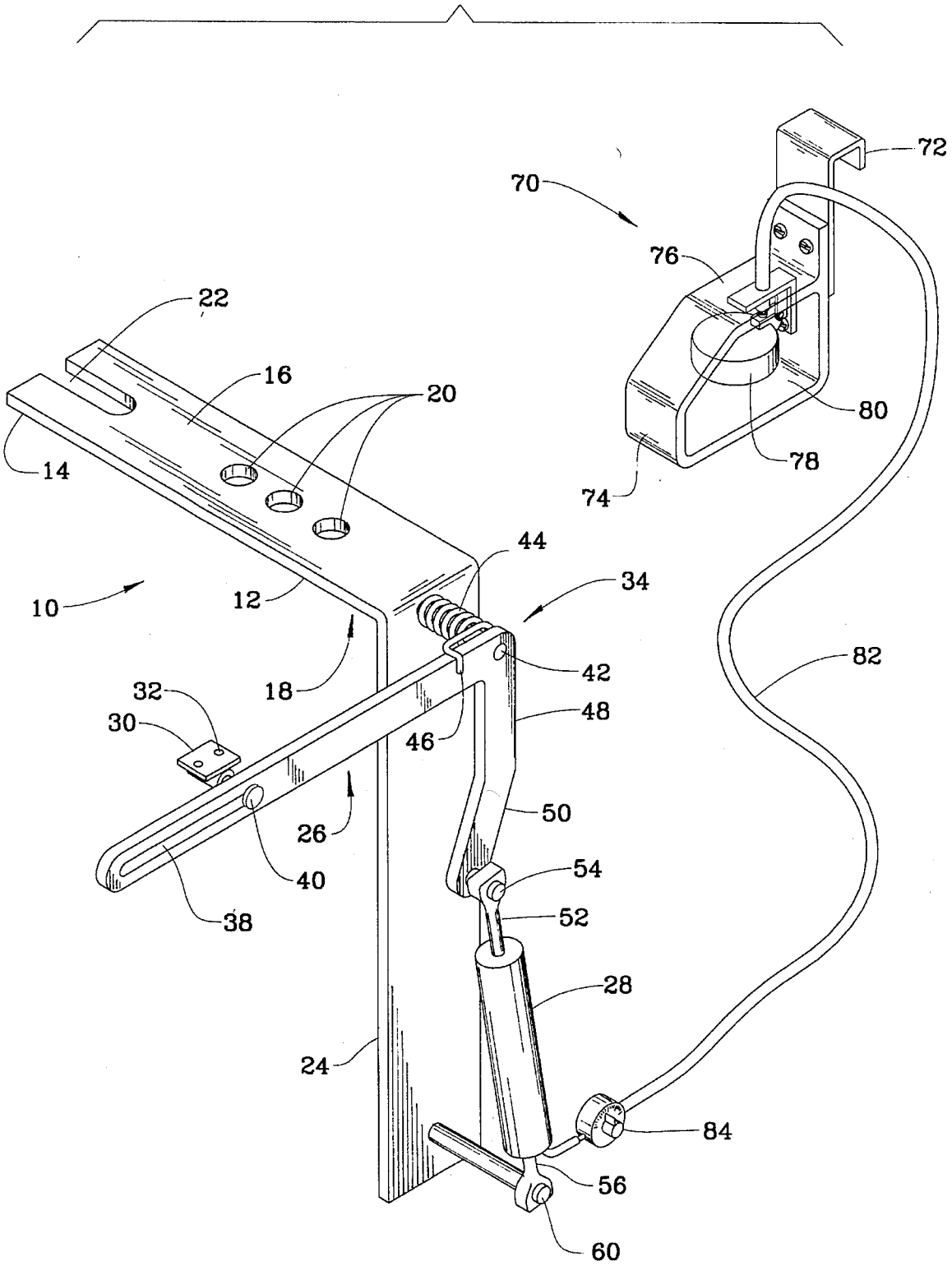
FIG. 1 is a pictorial view of the apparatus.

Now referring to FIG. 1, numeral 10 illustrates a seat closure member which forms a universal attachment for the base of toilet bowls. The seat closure member 10 is defined by an L-shaped rigid bracket 12 that conforms to a side surface of a toilet bowl or, as illustrated, is constructed of an aesthetically pleasing transparent material. The bracket has an upper horizontal section 14 with an upper surface 16 and lower surface 18 available for placement between the seat/seat cover coupling hinge of a toilet bowl, the toilet bowl seat/seat cover coupling hinge having mounting bolts for securement to the base of the toilet bowl. The bracket 12 includes a plurality of apertures 20 which are positionable beneath one said coupling hinge which operates in conjunction with slot 22 positioned along a proximal end of the bracket and made available for placement beneath a second coupling hinge of the seat/seat cover. In this manner the combination of aperture 20 and slot 22 allows for universal attachment to various seat designs by allowing a seat cover mounting bolt to be placed in either one of the apertures 20 to prevent movement of the bracket and a second bolt to be placed within slot 22 allowing a seat/seat cover to be off center without interfering with installation.

Once the upper horizontal section 14 is secure it is noted that a lower section 24 leading to a distal end of the bracket 12 is positioned perpendicular and in a downwardly facing position from the upper portion 14. The lower section 24 provides attachment for seat closure member 26 and control cylinder 28. The seat closure member 26 has a proximate end 30 shown in a parallel plane to the upper section 14 for attachment to a lower surface of a toilet seat by use of mounting bracket 32. When the seat is in a closed position, mounting bracket 32 is at a position closest to juncture 34. In this manner the mounting bracket 32 has an attachment pinion 40 which extends through slot 38 of the seat closure member allowing for the movement along the length of the slot 38. Juncture 34 is rotatably mounted to the lower section 24 of bracket 12 having boss 42 rotatably securing the seat closure member 26 to the bracket 12. Spring 44 has one end, not shown, attached to the bracket 12 and a second end 46 attached to the seat closure member 26 biasing it in a horizontal position. The seat closure member 26 has a leg forming a first portion 48 which is perpendicular to the proximal end of the seat closure member 26 with a distal end 50 thereof offset from the first portion 48 maintaining the control cylinder 28 in a non-vertical format. It is noted that if the control cylinder is placed in a vertical format, the device may lock and places undue stress on the biasing spring. The control cylinder 28 has a hollow chamber with uni-directional piston 31. Piston rod 52 is joined to seat closure member 26 by pinion 54 along distal end 50. Control cylinder 28 is fixed to lower section 24 of bracket 12 by coupling to support 56 with mounting bolt 60.

One embodiment for controlling this apparatus is by use of water level sensor 70 which is shown with an inverted U-shaped bracket 72 which allows the device to be placed into the water closet of a toilet bowl. The bracket 72 places a float housing 74 beneath the water line in the water closet when the water closet is in its normally filled position. Float housing 74 has an outer wall 76 which encompasses float 78 in a protective manner with sufficient openings as shown by open cavity 80 to allow water to access the float 78. As described later in this specification, the float controls the release of air from control cylinder 28 by use of a flexible air tube 82 which fluidly couples the components together. The amount of air released is controlled by air valve 84 placed in-line, the valve permits the escape of air to be controlled to allow a pre-determined speed for retraction of the piston rod 52.

Figure 2:
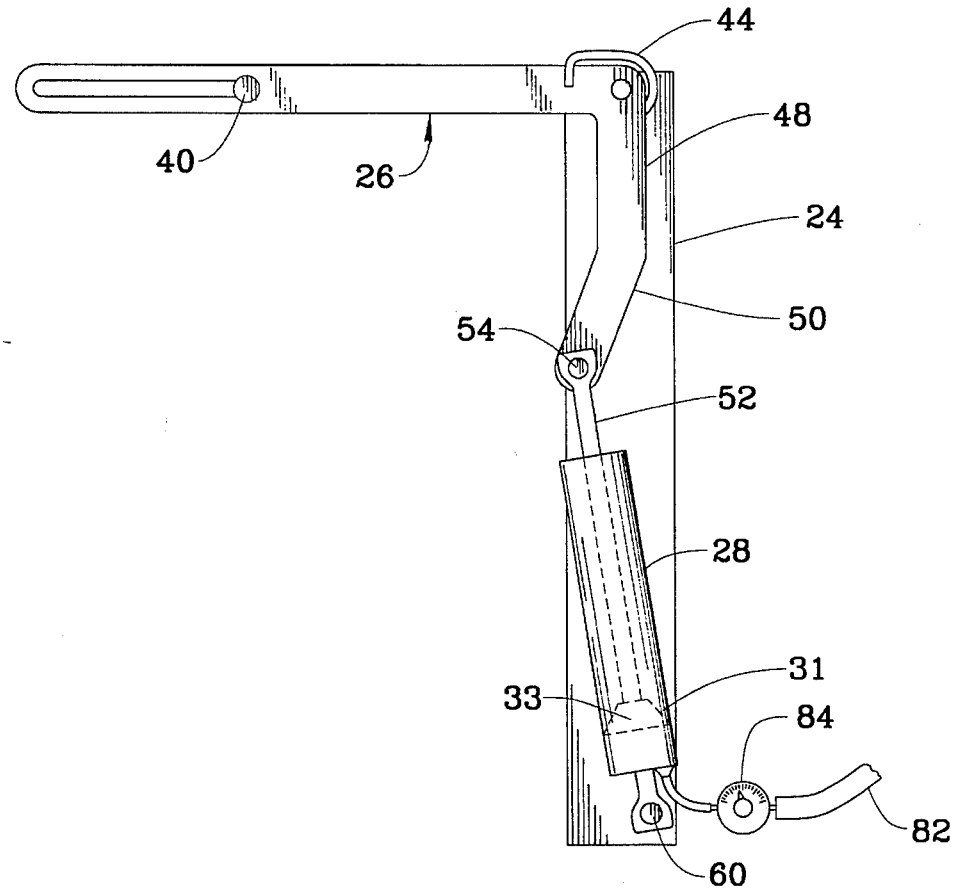
FIG. 2 is a side view of the support base and seat closure member of the apparatus.

Referring to FIG. 2 shown is a side view of the lower portion of the mechanism which attaches to the toilet bowl base. The lower portion shows lower section 24 with control cylinder 28 coupled by pinion 60 along distal end 50 of the seat closure member 26 by pinion 54 at the upper position. Flexible air tube 82 is coupled to air valve 84 for controlling the amount of air released from the cylinder when the seat is lowered through combination of the spring 44 and weight of the toilet seat. By way of illustration, the control cylinder 28 is in a normally closed position with the toilet seat in a horizontal position by attachment through pinion 40.

It should be noted that the instant invention operates for use with water saving tanks as well as hand and electric pumps commonly found on mobile homes and boats. In such instances, water is not held in a conventional water closet wherein a flush lever is used to initiate transfer of water for purposes of flushing the toilet bowl. In this manner, support base 12 is coupled to the toilet bowl where seat closure member 26 is coupled to a lower surface of a seat in combination with pinion 40. When the seat cover is lifted, the seat closure member is raised extending piston rod 52 from control cylinder 28 allowing air transfer around the conical shaped seal 31 into a void of the chamber 33. The seat cover is then allowed to slowly close, the rate of which is adjusted by valve 84 so that the seat cover may close over a period of time such as two or more minutes. This slow closure inhibits slamming of the toilet seat should the motor home hit a bump or the boat hit a wave while under travel. In addition, water saving toilets lacking a conventional water closet are allowed the benefits of the automatic closure mechanism. It should be noted that the support base may be eliminated if the device is used in OEM applications wherein the support base is integral with the structure of the toilet bowl, all deemed to be within the scope of this invention.

Figure 3:
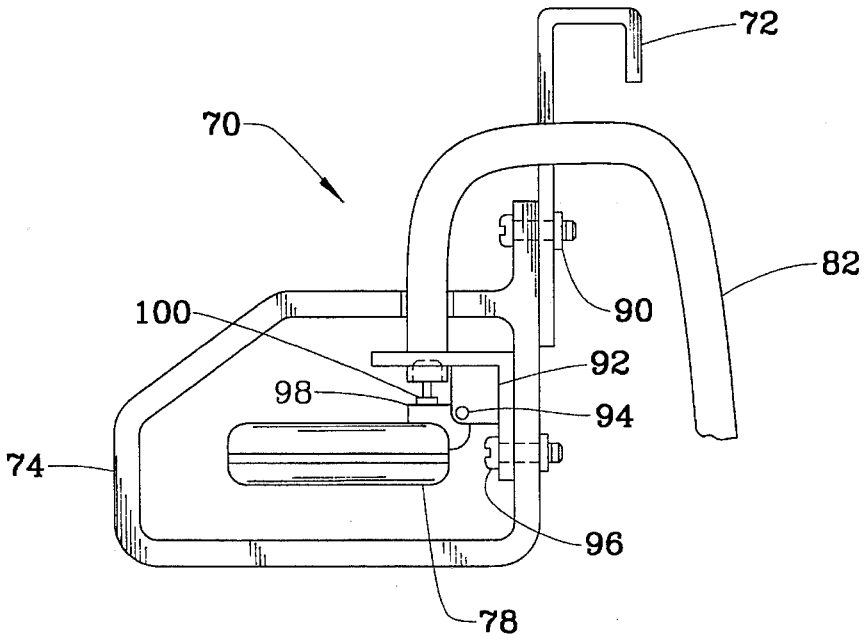
FIG. 3 is a side view of the water sensor of the apparatus.

Referring to FIG. 3 the water level sensor 70 of the apparatus consists of a hanger device 72 coupled to a bracket 74 by use of attachment screws 90. Float 78 is pivotally connected by float bracket 92 using pinion 94 and is coupled to bracket 74 by bolt 96. The float 78 has needle platform 98 for lifting of the needle valve 100 in relation to the positioning of the float 78. In operation, when the water level sensor means 70 is placed within a water closet, the water will lift float 78 forcing needle valve 100 into a needle seat, not shown, preventing air from escaping out of the flexible air tube 82. When the water level drops the tank float 78 is lowered allowing needle valve 100 to be dropped in relation to its biasing against platform 98 allowing air within the control cylinder which is fluidly communicated with the flexible air tube 82, to escape past needle valve 100.

Figure 4:
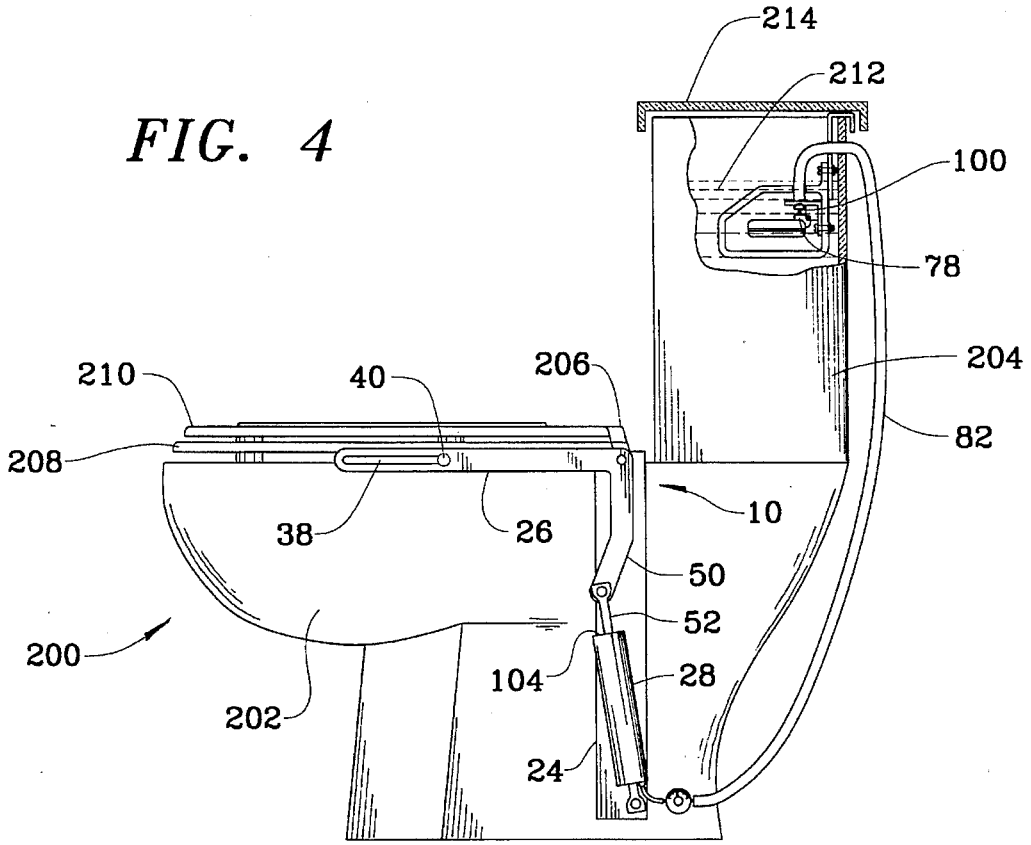
FIG. 4 is a cross sectional side view of the apparatus installed on a conventional toilet.
Figure 5:
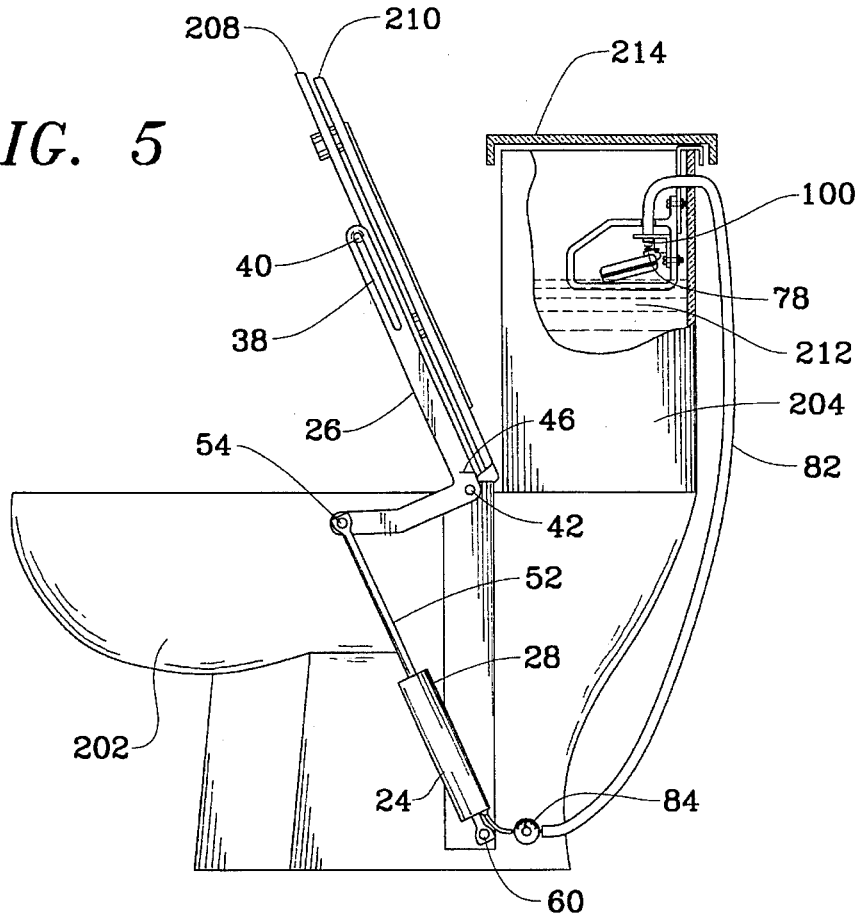
FIG. 5 is a cross sectional side view of the apparatus installed on a conventional toilet with the seat in a raised position.

Referring to FIGS. 4 and 5 set forth is a conventional toilet 200 having porcelain bowl 202 and porcelain water closet 204. The instant invention includes the seat closure member 10 coupled to an upper surface of bowl 202 by placement beneath mounting bolts 206 used to hold toilet seat 208 and toilet seat cover 210 to the bowl 202. In this position the toilet seat is closed wherein seat closure member 26 is shown in a parallel plane with toilet seat 208 with pinon 40 projecting through slot 38. Control cylinder 28 is in a normally closed position with piston rod 52 retracted into the control cylinder 50 positioning the lower portion 50 in a substantially vertical position. Float valve 78 is shown in a horizontal position with a level of water 212 forcing the float 78 in a raised position forcing needle valve 100 to seal preventing water from entering the flexible air tube 82 and air from escaping. The seat 208 and cover 210 may be lifted causing piston rod 52 to extend out of control cylinder 28 with air displacement through seal opening 104. It is noted that as the piston rod 52 is raised by action of moving the seat/seat cover upwardly thereby causing seat closure member 26 to be placed in a upright position and needle valve 100 to be pulled tightly into the seat to prevent the entrance of water into the flexible air tube 82.

Once seat 208 and seat cover 210 are placed in a raised position control cylinder 28 maintains piston rod 52 in an extended position as an internal air seal allows air to enter in one direction. As air is attempted to be pushed the other way, needle valve 100 prevents such movement. The seat 208 and cover 210 are then left in a raised position until water level 212 is reduced in the water closet 204 by flushing of the toilet. In this manner, float 78 is no longer biased in an upward position by the level of water and drops to an angled position allowing the needle valve 100 to drop from its sealing seat allowing air disposed within flexible air tube 82 to be expelled into the water chamber. Seat 208 and seat cover 210 are then lowered back to a horizontal plane as the weight of the covers push against piston rod 52 coupling through seat closure member 26 wherein air disposed within control cylinder 28 is pushed through flexible air tube 82 and needle valve 100.

Valve 84 is adjusted to allow seat 208 and seat cover 210 to lower slowly thereby preventing damage to the glass bowl and preventing a banging of the seat and seat cover against the toilet base 202. The slow closure prevents injury to small children. Once the cover and seat cover are horizontal the water closet 204 would have begun to refill causing float valve 78 to rise, sealing needle valve 100 into the aperture closing the flexible air tube 82.

It is to be understood that while we have illustrated and described certain forms of our invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An automatic seat lowering apparatus adapted for use in combination with a toilet bowl having an upper surface for pivotally mounting a seat by use of a coupling hinge, said automatic seat lowering apparatus comprising:

a support base having an upper horizontal section adapted to be positioned on the upper surface of the toilet bowl and secured thereto by placement beneath the seat coupling hinge, said support base having a lower section adapted to extend downwardly adjacent a side of the toilet bowl;

a seat closure member having a first leg with a first end and a second end, said first end adapted to be slidably coupled to a bottom surface of the seat, and an opposite second leg disposed perpendicular to said first leg, said second leg having a first end connected to said second end of said first leg and further having an opposite second end, said second and first ends of said first and second legs of said seat closure member forming a pivotal connection to said support base and coupled thereto by a pivot pin; and control cylinder means having a first end pivotally coupled to said first end of said second leg of said seat closure member and a second end pivotally coupled to said lower section of said support base, said control cylinder means having air trapped therein when said seat is raised and releases said trapped air when said seat descends from a raised position to a lowered position; and a valve means operatively associated with said control cylinder means for adjustably controlling said release of trapped air thereby to controllably effect seat closure.

2. The automatic seat lowering apparatus according to claim 1 including a biasing means operatively associated with said pivotal connection for providing a closing force against said seat closure member when said seat is rotated from said lowered position to said raised position.

3. The automatic seat lowering apparatus according to claim 1 wherein said control cylinder means has a hollow chamber with a piston slidably disposed therein, said piston having a piston rod extending outwardly from a first end of said cylinder means and coupled to said second end of said second leg of said seat closure member, said cylinder means having a second end coupled to said lower section of said support base.

4. The automatic seat lowering apparatus according to claim 3 wherein said piston includes a seal for trapping air in said chamber when said piston rod is extended outwardly, removal of air trapped in said chamber being effected by expulsion through said second end upon movement of said piston rod toward said second end.

5. An automatic seat lowering apparatus adapted for use in combination with a toilet bowl having an upper surface for pivotally mounting a seat by use of a coupling hinge, a water closet for storing water, and a lever for releasing stored water for flushing matter contained in the toilet bowl into a drain, said automatic seat lowering apparatus comprising:

a support base having an upper horizontal section adapted to be positioned on the upper surface of the toilet bowl and secured thereto by placement beneath the seat coupling hinge, said support base having a lower section adapted to extend downwardly adjacent a side of the toilet bowl;

a seat closure member having a first leg with a first end and a second end, said first end adapted to be slidably coupled to a bottom surface of the seat, and an opposite second leg disposed perpendicular to said first leg, said second leg having a first end connected to said second end of said first leg and further having an opposite second end, said second and first ends of said first and second legs of said seat closure member forming a pivotal connection to said support base and coupled thereto by a pivot pin; and control cylinder means having a first end pivotally coupled to said first end of said second leg of said seat closure member and a second end pivotally coupled to said lower section of said support base, said control cylinder means having air trapped therein when said seat is raised and releases said trapped air when said seat descends from a raised position to a lowered position; and a water level sensor means positionable in the water closet for detecting a predetermined high level of stored water therein, said sensor means operatively associated with said control cylinder means for preventing said release of trapped air in said cylinder means until said sensor means senses a drop in the water level in the water closet due to flushing the toilet bowl.

6. The automatic seat lowering apparatus according to claim 5 including a biasing means operatively associated with said pivotal connection for providing a closing force against said seat closure member when said seat closure member is rotated from said lowered position to said raised position.

7. The automatic seat lowering apparatus according to claim 5 wherein said control cylinder means has a hollow chamber with a piston slidably disposed therein, said piston having a piston rod extending outwardly from a first end of said cylinder means and coupled to said second end of said second leg of said seat closure member, said cylinder means having a second end coupled to said lower section of said support base.

8. The automatic seat lowering apparatus according to claim 6 wherein said piston includes a seal for trapping air in said chamber when said piston rod is extended outwardly, removal of air trapped in said chamber being effected by expulsion through said second end upon movement of said piston rod toward said second end.

9. The automatic seat lowering apparatus according to claim 8 including a valve means for regulating the release of air expelled from said chamber through said second end.

10. The automatic seat lowering apparatus according to claim 5 wherein said cylinder means is coupled to said water sensor means by a flexible air tube.

11. The automatic seat lowering apparatus according to claim 10 wherein said flexible air tube is coupled to said cylinder means and said water level sensor means by frictional engagement at opposite ends thereof with a hose barb nipple disposed on said second end of said cylinder means and on said sensor means.

12. The automatic seat lowering apparatus according to claim 10 wherein said water level sensor means includes a float operatively associated with a needle valve having a sealing seat fluidically connected to said flexible tube, said needle valve preventing the release of air trapped in said cylinder means when said float reaches a level corresponding to said high level of water stored in the water closet and said valve releases air trapped in said cylinder means when the level of water stored is lowered to a predetermined distance.

13. An automatic seat lowering apparatus adapted for use in combination with a toilet bowl having an upper surface for pivotally mounting a seat cover by use of a coupling hinge, a water closet for storing water, and a lever for releasing stored water for flushing matter contained in the bowl into a drain, said automatic seat lowering apparatus comprising:

a support base having an upper horizontal section adapted to be positioned on the upper surface of the toilet bowl and secured thereto by placement beneath the seat coupling hinge, said support base having a lower section adapted to extend downwardly adjacent a side of the toilet bowl;

a seat closure member having a first leg with a first end and a second end, said first end adapted to be slidably coupled to a bottom surface of the seat, and an opposite second leg disposed perpendicular to said first leg, said second leg having a first end connected to said second end of said first leg and further having an opposite second end, said second and first ends of said first and second legs of said seat closure member forming a pivotal connection to said support base and coupled thereto by a pivot pin; and control cylinder means having a first end pivotally coupled to said first end of said second leg of said seat closure member and a second end pivotally coupled to said lower section of said support base, said control cylinder means having air trapped therein when said seat is raised and releases said trapped air when said seat descends from a raised position to a lowered position; and a water level sensor means positionable in the water closet for detecting a predetermined high level of stored water therein; and a flexible air tube coupling said cylinder means and said water level sensor means for allowing said air trapped in said cylinder means to be released through said tube when said water level sensor means detects a water level below said high level.

14. The automatic seat lowering apparatus according to claim 13 including a spring means operatively associated with said pivotal connection for providing a biasing force against said seat closure member when said seat closure member is rotated from said lowered position to said raised position.

15. The automatic seat lowering apparatus according to claim 13 including a valve means disposed in said air tube for regulating the release of air from said cylinder means through said tube.

16. The automatic seat lowering apparatus according to claim 13 wherein said water level sensor means further includes a float operatively associated with a needle valve having a sealing seat fluidically connected to said flexible tube, said needle valve preventing the release of air trapped in said cylinder means when said float reaches a level corresponding to said high level of water stored in the water closet and said valve releases air trapped in said cylinder means when the level of water stored is lowered to a predetermined distance.

17. The automatic seat lowering apparatus according to claim 13 wherein said support base is constructed of a transparent material.

18. The automatic seat lowering apparatus according to claim 13 wherein said support base upper section has a plurality of apertures therein and an elongated slot disposed at a distal end thereof, said apertures and said slot providing accommodation for different sized mounting hinges.

* * * * *